US006347754B1

(12) United States Patent
Prus

(10) Patent No.: US 6,347,754 B1
(45) Date of Patent: Feb. 19, 2002

(54) ATOMIZING BOWL AND ELECTROSTATIC ROTARY SPRAYHEAD UNIT EQUIPPED THEREWITH

(75) Inventor: Eric Prus, Grenoble (FR)

(73) Assignee: Sames S.A, Meylan (FR)

( * ) Notice: Subject to any disclaimer, the term of this patent is extended or adjusted under 35 U.S.C. 154(b) by 0 days.

(21) Appl. No.: 09/647,198

(22) PCT Filed: Mar. 31, 1999

(86) PCT No.: PCT/FR99/00752

§ 371 Date: Sep. 27, 2000

§ 102(e) Date: Sep. 27, 2000

(87) PCT Pub. No.: WO99/49982

PCT Pub. Date: Oct. 7, 1999

(30) Foreign Application Priority Data

Apr. 1, 1998 (FR) ..... 98 04269

(51) Int. Cl.[7] ..... B05B 5/00; F23D 11/32

(52) U.S. Cl. ..... 239/690; 239/700; 239/706

(58) Field of Search ..... 239/700, 706, 239/690, 697, 698, 703, 705, 707, 231, 504, 223; 118/621, 629, 626, 630

(56) References Cited

U.S. PATENT DOCUMENTS

| | | | | |
|---|---|---|---|---|
| 2,901,178 A | | 8/1959 | Norris | |
| 4,324,361 A | * | 4/1982 | Moos et al. | 239/706 |
| 4,519,549 A | | 5/1985 | Yokoe et al. | |
| 4,737,897 A | | 4/1988 | Shipley et al. | |
| 4,744,513 A | | 5/1988 | Meisner et al. | |
| 4,842,203 A | * | 6/1989 | Kuhn et al. | 239/705 |
| 5,358,182 A | * | 10/1994 | Cappeau et al. | 239/112 |
| 5,816,508 A | * | 10/1998 | Hollstein et al. | 239/700 |

FOREIGN PATENT DOCUMENTS

| | | |
|---|---|---|
| BE | 882 450 | 7/1980 |
| EP | 0 094 796 | 11/1983 |
| EP | 0 104 394 | 4/1984 |
| EP | 0 107 030 | 5/1984 |
| EP | 0 219 409 | 4/1987 |
| EP | 0 913 202 | 5/1999 |
| FR | 1 438 510 | 4/1902 |

* cited by examiner

*Primary Examiner*—David A. Scherbel
*Assistant Examiner*—Davis Hwu
(74) *Attorney, Agent, or Firm*—Browdy and Neimark

(57) ABSTRACT

The invention concerns an atomizing bowl (4) for coating product electrostatic rotary sprayhead unit (1), said bowl comprising a bell (7) for distributing the product made from a conductive material and arranged to be brought to high voltage when the sprayhead unit is in operation, so as to charge electrostatically said product by contact. The invention is characterized in that said bell is electrically connected to at least one corona discharge element (22, 25, 28) from one tapered end **(22*a*, 25*a*, 25*b*, 28*a*), said tapered end being arranged in the proximity of said bowl outer surface. The bowl is electrically connected to a generator capable of detecting variations in the glow currents passing through the discharge elements (22, 25, 28)** or the bowl tips.

15 Claims, 4 Drawing Sheets

ATOMIZING BOWL AND ELECTROSTATIC ROTARY SPRAYHEAD UNIT EQUIPPED THEREWITH

CROSS REFERENCE TO RELATED APPLICATION

The present application is the national stage under 35 U.S.C. 371 of PCT/FR99/00752, filed Mar. 31, 1999.

The present invention relates to an atomiization bowl and to a rotating electrostatic sprayer for atomizing, a coating product, equipped with such a bowl.

It is known to equip a rotating coating-product sprayer with a bowl or bell fast with the rotor of a turbine for drive in rotation, in order to form a cloud of atomized coating product, this cloud being entrained by an electrostatic field and possibly by a flow of air, in the direction of an object to be coated. Essentially, two types of atomization bowls exist, namely atomization bowls made of an electrically conducting material and atomization bowls made of an electrically insulating material.

Bowls made of an insulating material do not allow the coating product to be electrostatically charged, with the result that ancillary means must be provided for charging the coating product through luminous or corona discharges. The charge of the coating product obtained is less efficient, with the result that the effect of the electrostatic field on the coating particles is lesser, the yield of deposit obtained being relatively low.

Bowls made of a conducting material allow the coating product to be electrostatically charged when it flows in contact with the surfaces of the bowl which is taken to high voltage by any appropriate means. These bowls generally present the drawback of constituting high electrical capacitances, potentially dangerous for a user and capable of creating electric arcs likely to set off a fire in the explosive atmosphere of a coating booth.

Furthermore, the electrostatic coating equipment and their peripherals undergo advanced safety tests in order to be sure that they are not likely to provoke an electrical discharge of which the energy would be greater than a predetermined threshold value. Certain standards provide, for example, that the breakdown or discharge energy between a part of the sprayer taken to high voltage and a sphere of small radius disposed at a distance of the order of a centimeter, must be less than 0.24 mJ. Such a value cannot be respected with a known bowl made of electrically conducting material as the edges and plane surfaces that it comprises, in particular near the edge for discharge of the coating product, are capable of producing discharges of much higher energy.

It is a particular object of the invention to overcome these drawbacks, by proposing an atomization bowl allowing a charge of the coating product by contact and for which the discharge or "breakdown" energy is maintained at a level lower than that imposed by the most restrictive standards.

To that end, the invention relates to an atomization bowl for a rotating electrostatic coating-product sprayer, said bowl comprising an end shield for distributing the product provided to be taken to high voltage when the sprayer is operating, so as to charge the product electrostatically by contact, characterized in that the end shield is electrically connected to at least one current discharge element through corona discharge from one end in the form of a tapered point, this end in the form of a tapered point being arranged in the vicinity of an outer surface of the bowl.

Thanks to the invention, the end shield, which constitutes the central part of the bowl, allows a charge by contact of the coating product during flow. The discharge element or elements create privileged paths of corona discharges between the end shield and the outside of the bowl, with the result that no accumulation of energy is possible at a level such that the breakdown energy would exceed the admissible values.

In addition, taking the modelizatioin of an earthed object which approaches the bowl, the approach of the object leads to an increase in the corona discharge Current translated by a drift of the current consumed, this drift being able to be detected by a high voltage generator used for supplying the end shield of the bowl with high voltage. In effect, known generators, such as in particular those of Applicants' patent applcation EP-A-0 219 409, are capable of reacting to an abnornal variation in the current. In this way, the variations in current generated by the discharge element or elements when an earthed object approaches, are detected by the generator sufficiently early for the safety function thereof to cancel the electrical supply before a potentially dangerous discharge of energy is possible.

According to a first advantageous aspect of the invention, the bowl comprises a plurality of discharge elements regularly distributed around its axis of rotation. This plurality of discharge elements makes it possible, when the bowl is switched on, to obtain the desired effect with a symmetry of revolution about the axis of rotation of the bowl, including in the absence of rotation. In addition, this distribution avoids a dynamic lack of balance of the bowl, i.e. an unbalance non-admissible at the speeds of rotation in question.

According to a first, particularly advantageous embodiment of the invention, the end shield is bordered, on its outer periphery, by a substantially annular piece made of a material which is electrically more insulating than the material of the end shield and forming an atomization edge of the bowl and the current discharge element is formed by an insert made of a material which is electrically more conducting than the annular piece and disposed in this annular piece, in electrical contact with the end shield, this insert extending up to the vicinity of an outer surface of the annular piece. The annular piece located on the periphery of the end shield avoids the risks of electrical breakdown between the plane surfaces taken to high voltage and an adjacent earthed object. The inserts, which are advantageously, but not necessarily metallic, constitute particularly effective discharge elements through the insulating or semi-conducting layer made by the annular piece around the end shield.

According to another advantageous aspect of the invention, the insert is partially received in a bore made in the conducting end shield. This particularly simple construction ensures an efficient electrical contact between the end shield and the insert, while guaranteeing its positioning with respect to the other components of the bowl.

According to another advantageous aspect of the invention, and in the case of a bowl comprising a deflector of the flow of coating product disposed opposite a so-called front surface of the end shield, the deflector bears at least one discharge element extending up to an outer, so-called front surface, of the deflector. The presence of this discharge element in the deflector also makes it possible to avoid the accumulation of electrostatic charges in this deflector and in the coating product in the course of flow around this deflector. The discharge element is advantageously an insert disposed along the axis of rotation of the bowl.

According to another advantageous aspect of the invention, the insert or inserts is or are in needle-form and provided with at least one end in the form of a point, this end being flush with the outer surface of the annular piece or of the deflector. In that case, at least one insert is advantageously provided to bear a flange adapted to cooperate with an inner shoulder of a housing for receiving the insert.

According to an advantageous variant embodiment of the invention, at least one insert is provided with two ends in the form of a point, these ends being flush with two outer surfaces of the annular piece, these outer surfaces being oriented respectively towards the axis of rotation and towards the outside of the bowl. This particular arrangement makes it possible to limit the value of the discharge energy both towards the central zone of the bowl and towards the outside.

According to another advantageous aspect of the invention, the end of the insert close to the outer surface of the bowl is disposed in the vicinity of the atomization edge. This arrangement is particularly advantageous, as it is near the atomization edge that there is more risk of encountering an earthed obstacle, such as a trap door or an unclosed door on the bodywork of an automobile in the course of being coated.

According to another, particularly advantageous embodiment of the invention, the discharge element is formed by a point fashioned on the outer surface of the end shield. This aspect of the invention makes it possible to produce an entirely conducting bowl, particularly efficient for the charge of the coating product by contact, while avoiding the above-mentioned problems of discharge with potentially dangerous levels of energy. In effect, the points formed by the discharge elements are supplied with high voltage via the mass of the end shield and constitute as many privileged points of discharge through corona discharge. The point or points are advantageously formed in one piece with the end shield.

The invention also relates to an electrostatic sprayer of coating product which comprises a bowl as described hereinabove and means for electrically connecting the end shield of this bowl to a high voltage generator, this generator being adapted to detect variations in the corona discharge current transiting through the discharge element or elements of the bowl. This sprayer complies with the most demanding safety standards, which corresponds to very high operational safety.

The invention will be more readily understood on reading the following description of three embodiments of an atomization bowl and of a sprayer on which it may be mounted, in accordance with its principle, given solely by way of example and with reference to the accompanying drawings, in which:

FIG. 1 schematically shows a rotating electrostatic coating-product sprayer according to the invention.

Figure 1:
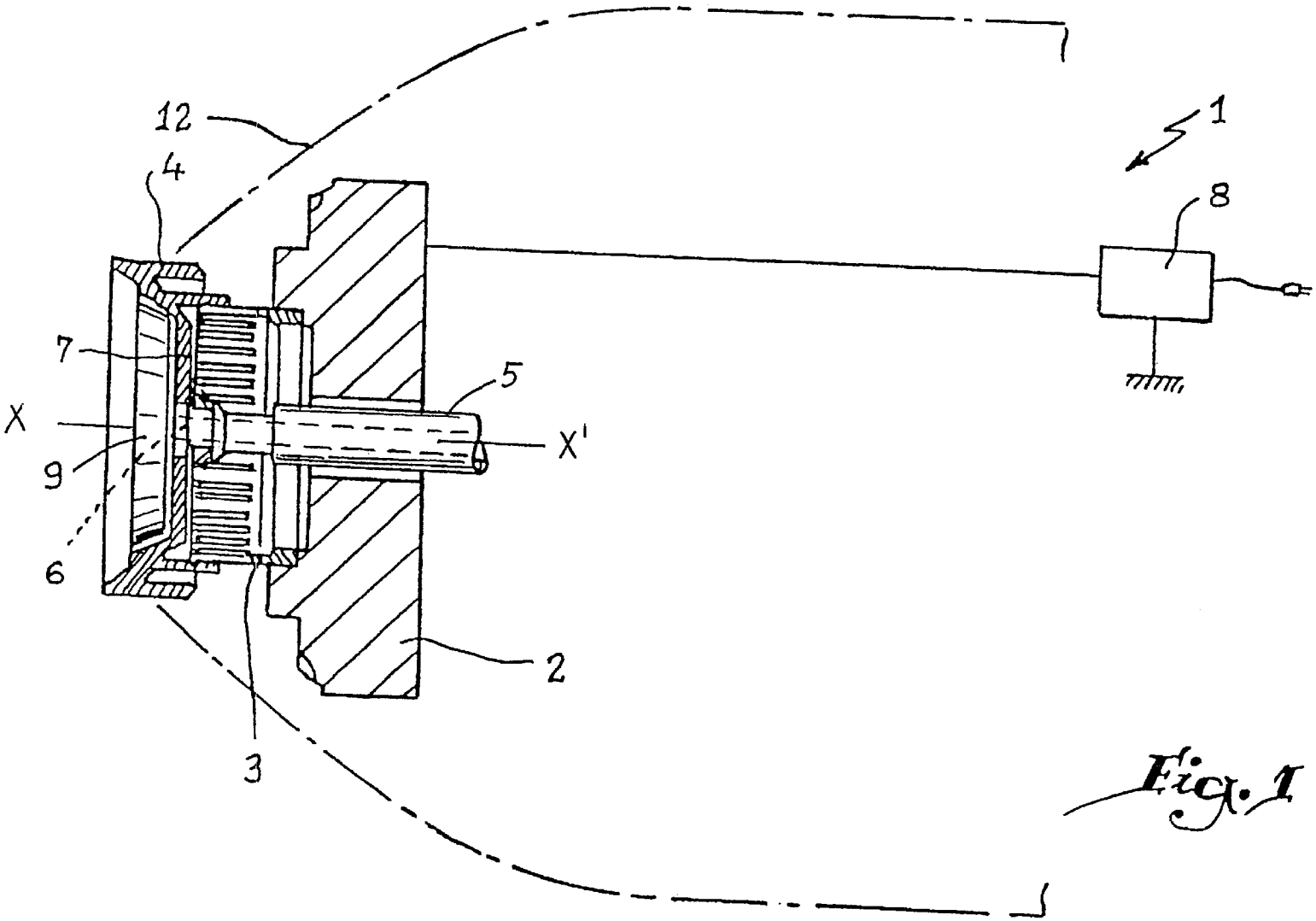

Referring now to the drawings, and firstly to FIG. 1, a rotating electrostatic coating-product sprayer 1 is shown, which comprises a rotor 2 driven in rotation by any suitable means and in particular by an air turbine or an electric motor. The rotor 2 bears an elastic ring 3 which may be in accordance with the technical teaching of EP-A-0 697 917. The elastic ring 3 makes it possible to render an atomization bowl 4 fast with the rotor 2. The rotor 2 is traversed by a fixed conduit 5 for conducting coating-product to the vicinity of a central orifice 6 for supplying the bowl 4 arranged in a end shield 7 extending substantially perpendicularly to the axis of rotation XX' of the rotor 2, the ring 3 and the bowl 4.

The rotor 2 is made of an electrically conducting material, for example metal, and connected by any appropriate means to a high voltage generator 8. The ring 3 and the end shield 7 are also made of electrically conducting materials, with the result that the high voltage issuing from the generator 8 is transmitted as far as the end shield 7. The end shield 7 is therefore able to charge, electrostatically by contact, the coating product which flows on its surface when it is supplied with high voltage by the generator 8 during operation of the sprayer 1.

The bowl 4 also comprises a deflector 9 disposed opposite the outlet orifice of the conduit 5 with respect to the end shield 7, i.e. opposite a so-called front surface 7*a* of the end shield 7. The deflector 9 is pierced with four conduits 10 which allows, during the bowl-cleaning phases, the flow of part of a solvent coming from conduit 5 on its outwardly directed, so-called front surface 9*a*. The deflector 9 is immobilized with respect to the end shield 7 by screws 11 traversing the end shield 7 and penetrating in rear bosses 9*b* of the deflector 9.

A substaintially annular piece 20, made of an electrically insulating plastics material, is disposed around an outer radial portion 7*b* of the end shield 7 and defines an edge 21 for atomization. of the of the coating product when the bowl 4 rotates. The piece 20 is advantageously glued on the end shield 7. It will also be noted that the respective shapes of the pieces 7 and 20 contribute to an immobilization of the piece 20 on the end shield 7 by cooperation of shapes.

Metallic inserts 22 in needle form are housed in eight blind bores 23 made both in the piece 20 and in the end shield 7. Each insert 22 comprises a first end 22*a* in the form of a point, disposed flush with the outer surface 20*a* of the piece 20 in the vicinity of the atomization edge 21. The second end 22*b* is driven in the bottom of the bore 23 which is arranged in the part 7*b* of the end shield 7.

In this way, the inserts 22, which are made of metal, are permanently taken to the same electrical potential as the end shield 7.

Figure 4:
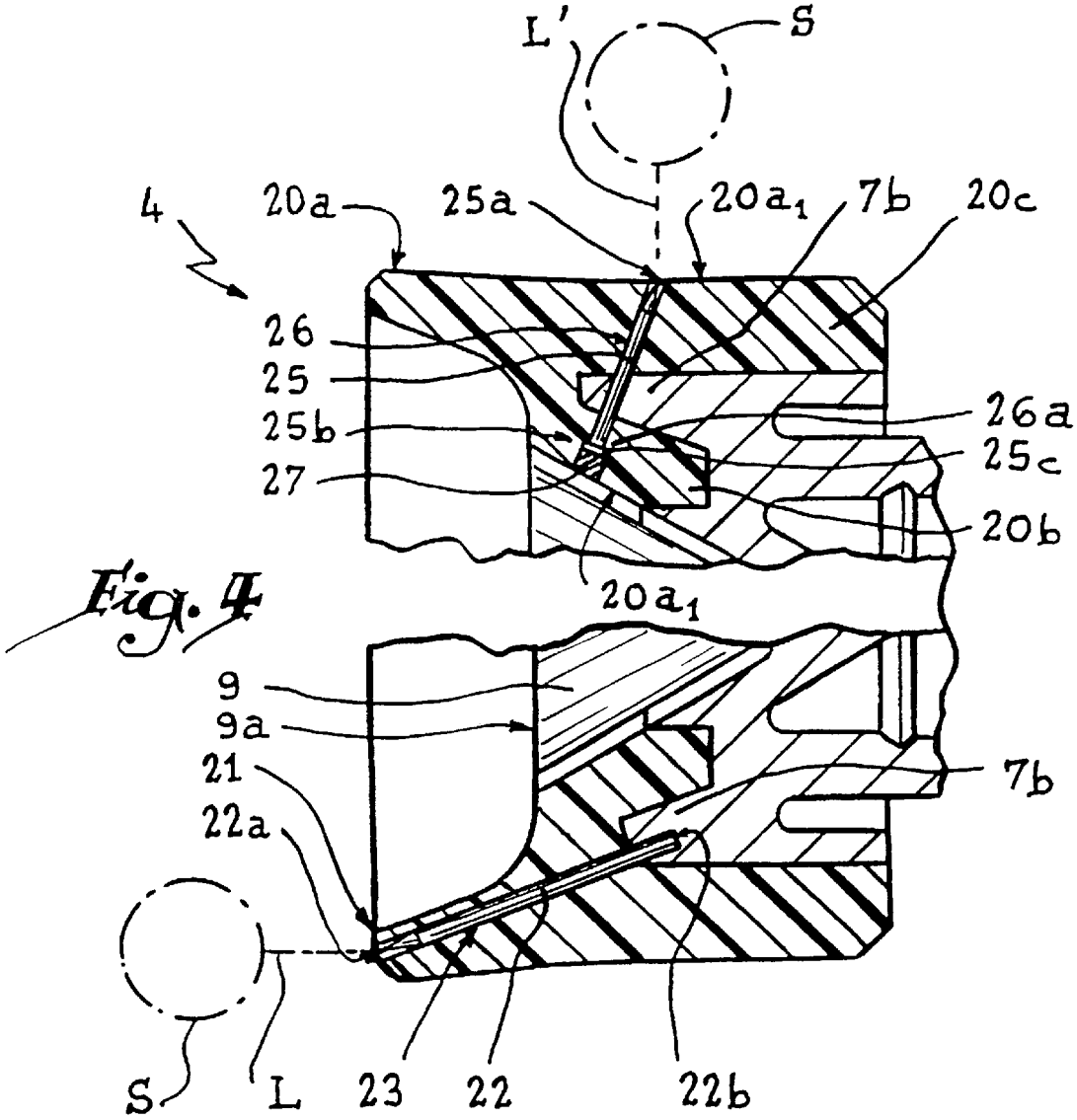
FIG. 4 is a view on a larger scale of two details IV of FIG. 3.

When an earthed object, represented by a sphere S in dot-and-dash lines in FIG. 4, is brought nearer the atomization edge 21, a line of discharge L is created as shown in broken lines. The inserts 22 therefore constitute as many discharge elements through corona discharge of the bowl 4. The line of discharge L results in a consumption of current which may be detected by the generator 8 in accordance with techniques known in particular by EP-A-0 219 409. The generator is then in a position to react to this sudden increase in current by cutting off the supply of the bowl in order to avoid the level of energy potentially attained during a discharge through spark being greater than an imposed value.

It will be understood that the fact that the bowl comprises a plurality of inserts 22 distributed about axis XX' makes it possible to multiply the effect described hereinabove and to ensure symmetry thereof about this axis.

Figure 3:
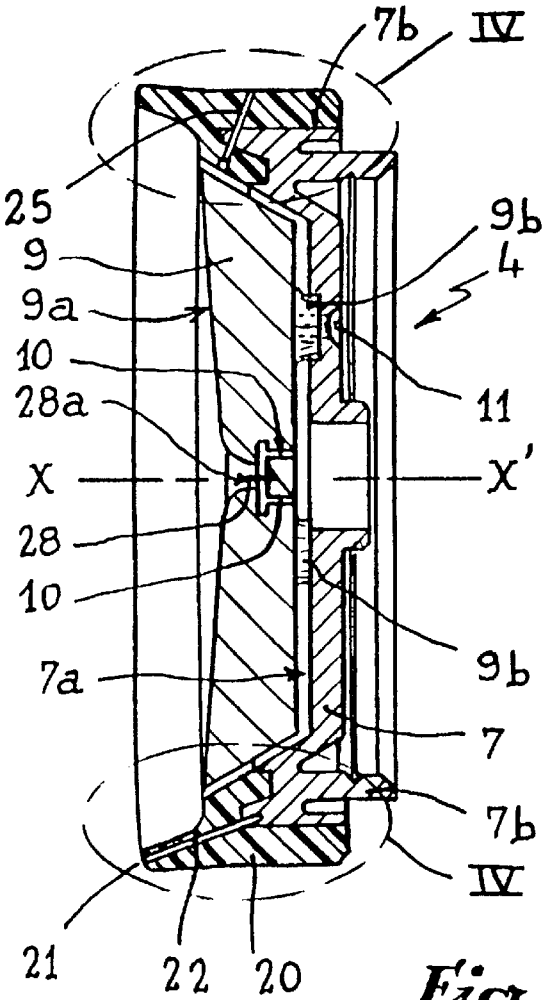
FIG. 3 is a section along line III—III in FIG. 2.

In addition, and as is more particularly visible in FIGS. 3 and 4, a second series of eight inserts 25 is disposed through the piece 20 and the outer radial part 7*b* of the end shield 7, each insert 25 comprising a first end 25*a* in the form of a point disposed in the immediate vicinity of the outer part $\mathbf{20}a_1$, of the outer surface 20*a*.

The points 25*a* of the inserts 25 are directed towards the rear of the bowl 4, in the direction of the outer surface of a hood 12 of the sprayer 1 shown in dot-and-dash lines in FIG. 1. In effect, no earthed object can be brought closer to the points 25*a* through the hood 12 which is insulating, with the result that this hood limits the potential approach zone of an earthed object.

As before, upon the approach of an earthed object, represented in dot-and-dash lines by a sphere S, a line of discharge L' is created from the point 25*a* of the insert 25.

Each insert 25 bears, at its second end 25*b*, a head or flange 25*c* capable of cooperating with a shoulder 26*a* of a bore 26 for receiving the insert 25. This makes it possible to position with precision the first end 25*a* of the insert 25 with respect to the outer surface $\mathbf{20}a_1$ of the piece 20. A stopper 27 of glue or of resin is advantageously arranged in that part of the bore 26 opposite the point 25*a*, so that that part $\mathbf{20}a_2$ of the outer surface 20*a* directed towards axis XX' does not present irregularities in which the coating product might accumulate.

The relative immobilization of pieces 7 and 20 is improved by positioning the inserts 25 through two parts 20*b* and 20*c* of the piece 20 disposed on either side of the outer part 7*b* of the end shield 7.

Figure 2:
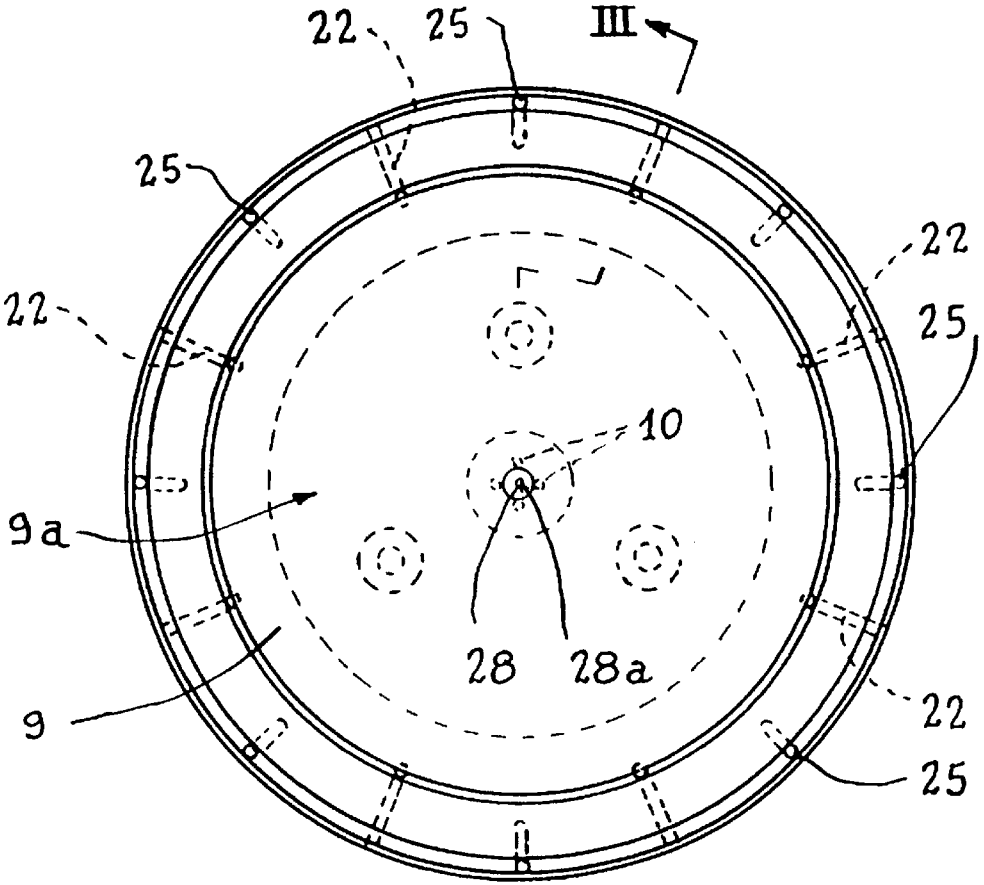
FIG. 2 is a front view on a larger scale of the bowl used with the sprayer of FIG. 1.

Returning to FIGS. 2 and 3, it will be noted that an insert 28 is arranged in the deflector 9 and comprises a first end 28*a*, in the form of a point, disposed flush with the front surface 9*a* of the deflector 9. If the deflector 9 is made of electrically conducting material, the insert 28 is taken to the same electrostatic potential as the end shield 7, with the result that it is capable of generating a line of discharge, as explained hereinbefore with reference to inserts 22 and 25. It should be noted here that, even if it is arranged within an electrically conducting surface taken to high voltage through the bosses 9*b*, the point of the insert 28 constitutes a privileged zone of discharge with respect to the surface 9*a* of the deflector 9.

As indicated hereinabove with reference to inserts 22, the corona discharges generated at the points of the inserts 25 and 28 are detected by the generator 8.

It is also possible for the deflector 9 to be made of electrically insulating material, in which case the insert 28 is taken to a floating potential. In that case, the point 28*a* also serves for the corona discharge of the electrostatic charges drained by the insert 28 on the surface of the deflector 9.

Whatever the materials used for the deflector 9, the insert 28 avoids the electrical capacitance of the conduit 5, of its support and of the turbine associated with the rotor 2, discharging through the conduits 10 for rinsing the front surface 9*a* of the deflector.

Figure 5:
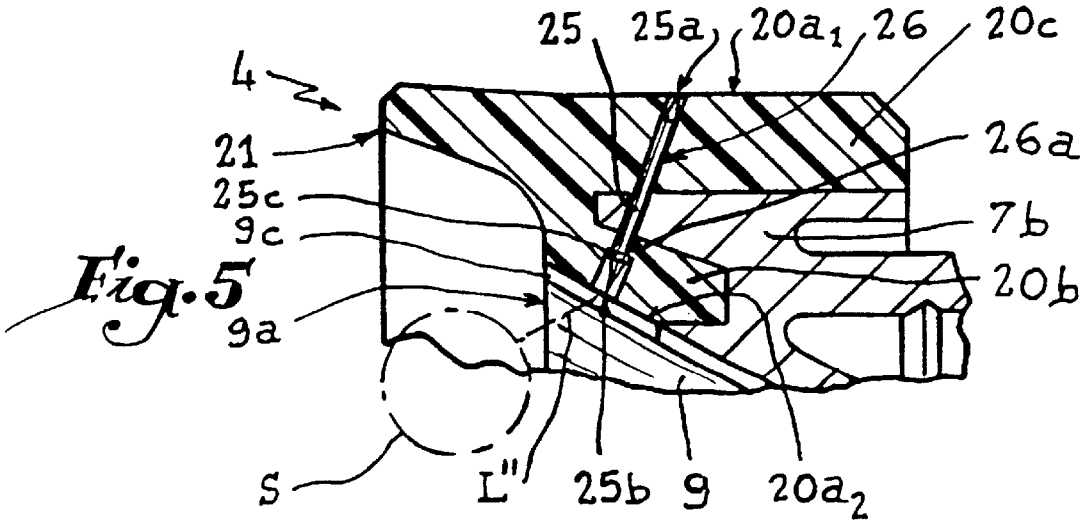
FIG. 5 is a view similar to the top part of FIG. 4 for a bowl in accordance with a second embodiment of the invention.

In the second embodiment of the invention shown in FIG. 5, elements similar to those of the embodiment of the preceding Figures bear identical references. This embodiment essentially differs from the preceding one in that the inserts 25 comprise a tapered point at each end 25*a* or 25*b*. This also makes it possible to create a line of discharge L" towards the surface 20*a*, of the piece 20 when a sphere S, at earth potential, is approached in the direction of point 25*b*. The pointed ends 25*b* avoid the creation of electric arcs or of high-energy discharges between the front circular edge 9*c* of the deflector and an earthed object in the position of the sphere S in FIG. 5.

In the two embodiments envisaged, the presence of the flange 25*c* and of the shoulder 26*a* guarantees that there is no risk of the inserts 25 being ejected from the bowl under the effect of the intense centrifugal forces to which they are submitted due to the high speeds of rotation of the atomization bowl which may reach, and even exceed, 80 000 revolutions per minute.

The material used for making the end shield 7 is advantageously based on aluminium, which allows it to present a good dimensional stability, which is an essential property when the bowl is rotated at high speed. The material used for the piece 20 may be a polyoxymethylene-based resin. Finally, the inserts 22, 25 and 28 may be made of steel or aluminium.

The annular piece 20 may also be made of a semi-conducting material, as it suffices that piece 20 has a resistivity greater than that of the inserts 22 or 25 for the latter to constitute privileged paths of discharge. In accordance with another alternative and when the piece 20 is made of an electrically insulating material, the inserts 22 and 25, and even insert 28, may be provided to be made of a semi-conducting material.

Figure 6:
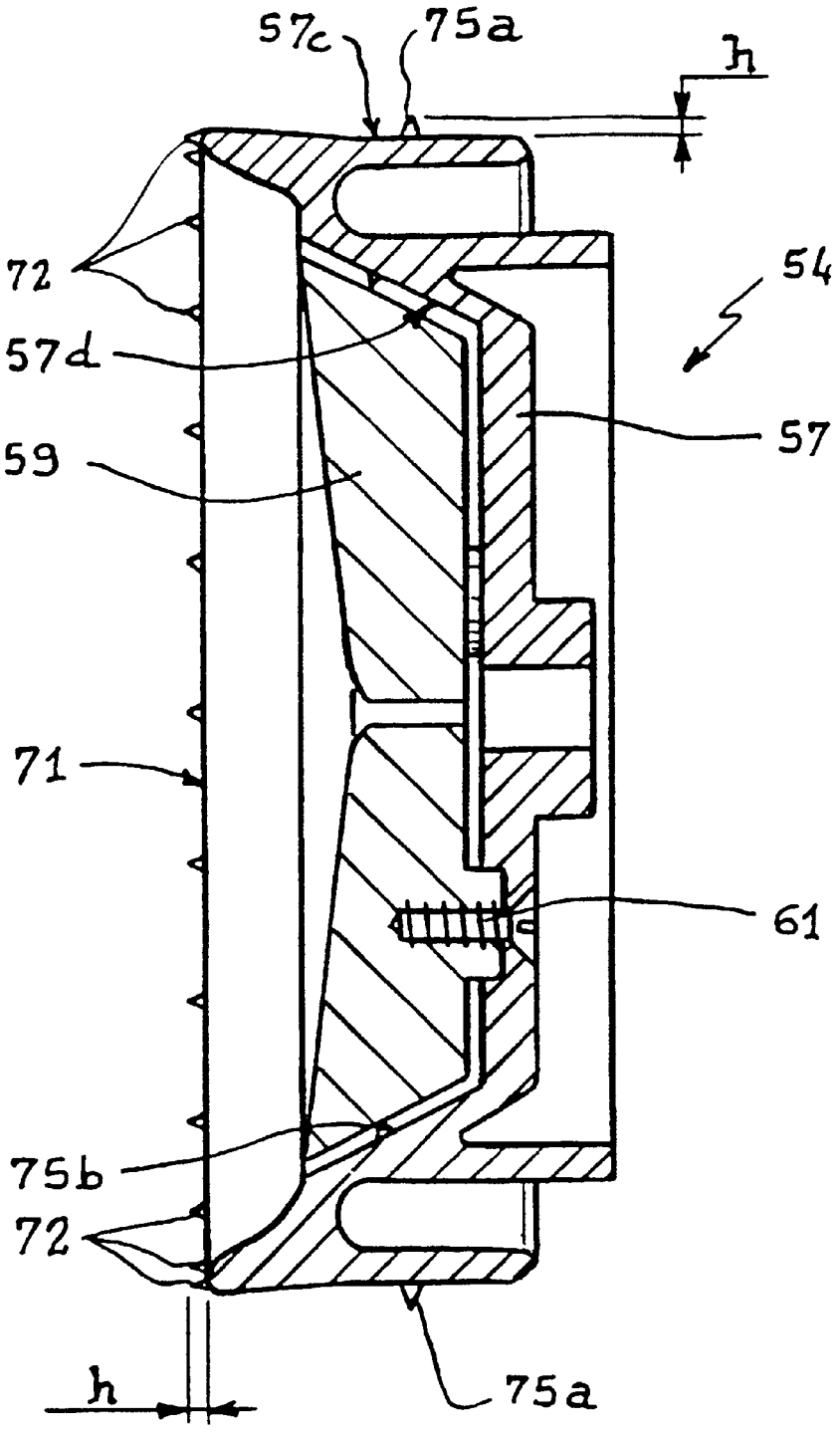
FIG. 6 is a section similar to FIG. 3 for a bowl in accordance with a third embodiment of the invention.

In the third embodiment of the invention shown in FIG. 6, elements similar to those of the embodiment of FIGS. 1 to 4 bear identical references increased by 50. The bowl 54 shown in FIG. 6 may be mounted on the sprayer schematically shown in FIG. 1. This bowl essentially comprises an end shield 57 made of an electrically conducting material on which a deflector 59 is fixed by means of a plurality of screws 61. This bowl essentially differs from those of the preceding embodiments in that it does not comprise an annular piece more insulating than the end shield 57, but, on the contrary, in that the end shield 57 extends radially up to the outside so as to constitute the atomization edge 71. 57*c* designates the outer peripheral surface of the end shield 57. On this surface 57*c*, there are provided a plurality of spikes 75*a* integral with the end shield 57. In the same way, a plurality of spikes 72 are provided on the atomization edge 71. Finally, spikes 75*b* are disposed on an inner surface 57*d* of the end shield 57 directed towards the deflector 59.

As before, the spikes 72 to 75*a* and 75*b* constitute as many privileged discharge zones through corona discharge of the electrical capacitance constituted by the end shield 57 as a whole. The variations in consumption of current induced by the corona discharges, when a line of discharge is created, particularly by the approach of an earthed object, may be detected by the generator 8 mentioned with reference to the first embodiment.

The spikes 72, 75*a* and 75*b* present a height h with respect to the atomization edge 71 or to the surfaces 57*c* and 57*d* of the order of 1 to 2 mm, which allows them to create zones of discharge through corona discharges without presenting any danger for a user manipulating the bowl 54.

As in the first embodiment of the invention, the deflector 59 may be equipped with an insert for discharge through corona discharge, and may even be provided, in its central part, with a point of the spike 72 type.

What is claimed is:

1. Atomization bowl (4) for a rotating electrostatic coating-poduct sprayer (1), said bowl comprising an end shield (7) for distributing the product, made of an electrically conducting material and provided to be taken to high voltage when the sprayer is operating, so as to charge said product electrostatically by contact, characterized in that said end shield is bordered, on its outer periphery (7*b*), by a substantially annular piece (20) made of an electrically insulating material and forming an atomization edge (21), in that at least one electrically conducting insert (22, 25) for discharge of current by corona discharge from one end (22*a*, 25*a*, 25*b*), is disposed in said annular piece, in electrical contact with said end shield (7), and in that said end (22*a*, 25*a*, 25*b*) of said insert is in the form of a sharp point and extends up to the vicinity of an outer surface (20*a*) of said annular piece.

2. Atomization bowl according to claim 1, characterized in that said insert (22, 25) is partially received in a bore (23, 26) made in said conducting end shield (7).

3. Atomization bowl according to one of claim 1, comprising a deflector (9) for deflecting the flow of coating product disposed opposite a so-called front surface (7*a*) of said end shield (7), characterized in that said deflector bears at least one discharge element (28) extending up to a so-called front outer surface (9*a*) of said deflector.

4. Atomization bowl according to claim 3, characterized in that said discharge element is an insert (28) disposed along the axis of rotation (XX') of said bowl (4).

5. Atomization bowl according to claim 1, characterized in that said insert or inserts (22, 25, 28) is/are in needle form and provided with at least one end (22*a*, 25*a*, 28*a*) in the form of a point, said end being flush with said outer surface (20*a*, 20$a_1$, 20$a_2$, 9*a*) of said annular piece (20) or of said deflector (9).

6. Atomization bowl according to claim 5, characterized in that at least one insert (25) bears a flange (25*c*) adapted to cooperate with an inner shoulder (26*a*) of a housing (26) for receiving said insert.

7. Atomization bowl according to claim 5, characterized in that at least one insert (25) is provided with two ends (25*a*, 25*b*) in the form of a point, said ends being flush with two outer surfaces (20$a_1$, 20$a_2$ of said annular piece (20), said outer surfaces being oriented respectively towards the axis of rotation (XX') of the bowl (4) and towards the outside of the bowl.

8. Atomization bowl according to claim 1, characterized in that the end (22*a*) of said insert (22) close to the outer surface (20*a*) of said bowl is disposed near said atomization edge (21).

9. Atomization bowl according to claim 1, characterized in that it comprises a plurality of discharge elements or inserts (22, 25; 72, 75*a*, 75*b*) regularly distributed around the axis of rotation (XX') of said bowl (4; 54).

10. Rotating electrostatic coating product sprayer (1), characterized in that it comprises a bowl (4; 54) according to claim 1 and means (2, 3) for electrical connection of the end shield (7, 57) of said bowl to a high voltage generator (8), said generator being adapted to detect variations of the corona discharge current transiting via said discharge elements or inserts (22, 25; 72, 75*a*, 75*b*) of said bowl.

11. Atomization bowl (54) for a rotating electrostatic coating-product sprayer (1), said bowl comprising an end shield (57) for distributing the product, made of an electrically conducting material and provided to be taken to high voltage when the sprayer is operating, so as to charge said product electrostatically by contact, characterized in that said end shield is provided, on an outer peripheral surface (57*c*), with an element for discharge of current by corona discharge in the form of a sharp point (75*a*) in one piece with said end shield, said sharp point being substantially orthogonal to said outer peripheral surface.

12. Atomization bowl according to claim 11, characterized in that it comprises discharge points (75*b*) arranged on an inner surface (57*d*) of said end shield (57) directed towards a deflector (59) of said bowl (54).

13. Atomization bowl according to claim 11, characterized in that it comprises points (72) provided on an atomization edge (71) of said bowl, said points having a height (h) with respect to said edge allowing them to create zones of discharge by corona discharge.

14. Atomization bowl according to claim 11, characterized in that it comprises a plurality of discharge elements or inserts (22, 25; 72, 75*a*, 75*b*) regularly distributed around the axis of rotation (XX') of said bowl (4;54).

15. Rotating electrostatic coating product sprayer (1), characterized in that it comprises a bowl (4; 54) according to claim 11 and means (2, 3) for electrical connection of the end shield (7, 57) of said bowl to a high voltage generator (8), said generator being adapted to detect variations of the corona discharge current transiting via said discharge elements or inserts (22, 25; 72, 75*a*, 75*b*) of said bowl.

* * * * *